US007182687B2

(12) United States Patent
Kennedy et al.

(10) Patent No.: US 7,182,687 B2
(45) Date of Patent: Feb. 27, 2007

(54) AIR DEFLECTING MINE VENTILATION STRUCTURE

(76) Inventors: John Matthew Kennedy, P.O. Box 138, Taylorville, IL (US) 62568; William R. Kennedy, P.O. Box 138, Taylorville, IL (US) 62568

( * ) Notice: Subject to any disclaimer, the term of this patent is extended or adjusted under 35 U.S.C. 154(b) by 46 days.

(21) Appl. No.: 11/036,493

(22) Filed: Jan. 14, 2005

(65) Prior Publication Data

US 2006/0172683 A1 Aug. 3, 2006

(51) Int. Cl.
*E21F 1/14* (2006.01)

(52) U.S. Cl. ..... 454/168; 454/169

(58) Field of Classification Search ..... 454/168, 454/169, 170, 171, 172
See application file for complete search history.

(56) References Cited

U.S. PATENT DOCUMENTS 4,483,642 A 11/1984 Kennedy et al.
4,621,951 A 11/1986 Dewson
4,820,081 A 4/1989 Kennedy et al.
5,174,682 A 12/1992 Whitfield
5,412,916 A 5/1995 Kennedy et al.
5,466,187 A 11/1995 Kennedy et al.
5,879,231 A 3/1999 Sisk
6,129,483 A 10/2000 Juracko
6,256,946 B1 7/2001 Kennedy et al.
6,264,549 B1 7/2001 Kennedy et al.
6,669,551 B2 12/2003 Kennedy et al.

*Primary Examiner*—Gregory Wilson
(74) *Attorney, Agent, or Firm*—Senniger Powers

(57) ABSTRACT

A mine ventilation structure is incorporated at the intersection of first and second intersecting passages in a mine. The ventilation structure comprises a tunnel-forming construction (e.g., a pair of side walls each walling off at least a portion of a respective mouth of a first passage and a deck spanning the side walls and connected thereto). The construction defines a tunnel establishing communication of air from the upstream to the downstream mouth of the second passage. An air deflector is located in the first passage adjacent the tunnel-forming construction for decreasing shock loss associated with the mine ventilation structure, thereby increasing the amount of air flow produced by the mine's ventilation system.

21 Claims, 11 Drawing Sheets

AIR DEFLECTING MINE VENTILATION STRUCTURE

FIELD OF THE INVENTION

The invention relates generally to mine ventilation structures and more particularly to air deflecting mine ventilation structures for use at an intersection of mine passages.

BACKGROUND

Mine ventilation structures such as overcasts and undercasts are widely used in mines to prevent mixing of forced (or induced) ventilation air flowing in one passage with forced (or induced) ventilation air flowing in another passage at an intersection of those passages. Generally, an overcast comprises a tunnel (e.g., made of two sidewalls and a deck) erected in one of the passages and extending through the intersection with the other passage. The tunnel blocks communication of air between the passages at the intersection, but permits air in one of the passages to flow through the tunnel and permits air in the other passage to flow through the intersection in a space between the top of the tunnel and the roof. Additional details relating to the construction and operation of overcasts is provided in U.S. Pat. Nos. 6,264,549 and 5,466,187, both of which are hereby incorporated by reference. An undercast is similar to an overcast, but the tunnel is formed adjacent the roof of the intersection (e.g., the sidewalls a deck are inverted and suspended above the floor). Air in one of the passages flows through the tunnel of the undercast and the air in the other passage flows through the intersection in a space between the bottom of the tunnel and the floor of the intersection.

Ventilation air can impart substantial forces on an overcast or undercast. The static pressure difference between the two passages can be significant and can generate substantial air loading on the overcast or undercast. The velocity of air flowing through the passages generates some minor additional loading. Overcasts and undercasts have to be robust enough to withstand the air loading and other forces acting on them. The construction and operation of undercasts is generally similar to that of overcasts, except that the sidewalls and deck are inverted to form the tunnel adjacent the roof of the intersection.

Overcasts and undercasts hinder flow of ventilation air through a mine. Shock loss (i.e., energy wasted by abrupt changes in the direction of air flow) is associated with the flow of air in the passage bypassing the tunnel (e.g., between the top of the tunnel of an overcast and the roof), adding to the energy required to ventilate the mine. For example, the shock loss associated with some overcasts is equivalent to the friction loss associated with about 70 feet of an ordinary unobstructed airway. Further, a mine can have multiple overcasts and/or undercasts, each of which adds to the energy demands for the mine's ventilation system.

In order to reduce the shock loss from an overcast, tailings, dirt or the like may be piled against the sides of the overcast to form a debris ramp extending up from the floor of the passage thereby altering the flow of air around the tunnel. Although this can reduce the shock loss associated with use of the overcast, the overcast has to be made more robust to withstand not only the air loading but also the additional forces imparted by the weight of the debris against it. This increases the cost of the overcast. Further, the material piled against the overcast has to be removed before the overcast can be removed from the intersection, making it inconvenient to uninstall the overcast and use it at another location.

SUMMARY OF INVENTION

In one aspect of the invention, a mine ventilation structure is incorporated at the intersection of first and second intersecting passages in a mine. The passages constitute first and second airways for flow of air for mine ventilation. The intersection has a floor and a roof. The airways each have a floor, ribs at the sides and a roof with an upstream and a downstream mouth at the intersection. The mine ventilation structure comprises a tunnel-forming overcast at the intersection. The overcast comprises a pair of side walls each walling off at least a portion of a respective mouth of the first airway and a deck spanning the side walls and connected thereto. The space between the side walls and below the deck constitutes a tunnel for flow of air from the upstream to the downstream mouth of the second airway. The roof above the deck and the roof of the first airway adjacent the ends of the deck are formed to provide an above-the-deck passage establishing communication for flow of air through the first airway over the deck from one side of the overcast to the other. The mine ventilation structure also comprises an air deflector in the first airway adjacent the overcast. The air deflector comprises an inclined wall. A lower edge of the inclined wall is spaced from the overcast in the first airway. The inclined wall slopes up from its lower edge toward the above-the-deck passage.

In another aspect of the invention, a mine ventilation structure is incorporated at the intersection of first and second intersecting passages in a mine. The passages constitute first and second airways for flow of air for mine ventilation. The intersection has a floor and a roof. The airways each have a floor, ribs at the sides and a roof with an upstream and a downstream mouth at the intersection. The mine ventilation structure comprises a tunnel-forming overcast at the intersection. The overcast comprises a pair of side walls each walling off at least a portion of a respective mouth of the first airway and a deck spanning the side walls and connected thereto. The space between the side walls and below the deck constitutes a tunnel for flow of air from the upstream to the downstream mouth of the second airway. The roof above the deck and the roof of the first airway adjacent the ends of the deck are formed to provide an above-the-deck passage establishing communication for flow of air through the first airway over the deck from one side of the overcast to the other. The mine ventilation structure also comprises an air deflector in the first airway adjacent a side of the overcast for deflecting the flow of air in the first airway. The air deflector comprises at least one prefabricated panel having a lower edge spaced apart from the overcast in the first airway and extending up from its lower edge toward the above-the-deck passage.

In yet another aspect of the invention a mine ventilation structure is incorporated at the intersection of first and second intersecting passages in a mine. The passages constitute first and second airways for flow of air for mine ventilation. The intersection has a floor and a roof. The airways each have a floor, ribs at the sides and a roof with an upstream and a downstream mouth at the intersection. The ventilation structure comprises a tunnel-forming construction. The tunnel-forming construction comprises a pair of side walls each walling off at least a portion of a respective mouth of the first airway and a deck spanning the side walls and connected thereto. The side walls and deck in combination with one of the floor and roof of the intersection define a tunnel establishing communication of air from the upstream to the downstream mouth of the second airway. At least one of: (a) the roof of the intersection and the roof of the first airway adjacent the ends of the tunnel-forming construction; and (b) the floor of the intersection and the floor of the first airway adjacent the ends of the tunnel-forming construction are formed to provide a passage establishing communication for flow of air through the first airway from one side of the tunnel-forming construction to the other. The side walls and deck substantially maintain separation of the flow of air from the upstream to the downstream mouth of the second airway from the flow of air from the upstream to the downstream mouth of the first airway. The ventilation structure also comprises an air deflector in the first airway adjacent the tunnel-forming construction. The air deflector comprises an inclined wall having a first edge in the first airway spaced from the tunnel-forming construction. The inclined wall slopes from the first edge toward said passage for flow of air through the first airway.

BRIEF DESCRIPTION OF DRAWINGS

Corresponding reference numbers indicate corresponding parts throughout the drawings.

DETAILED DESCRIPTION

Figure 1:
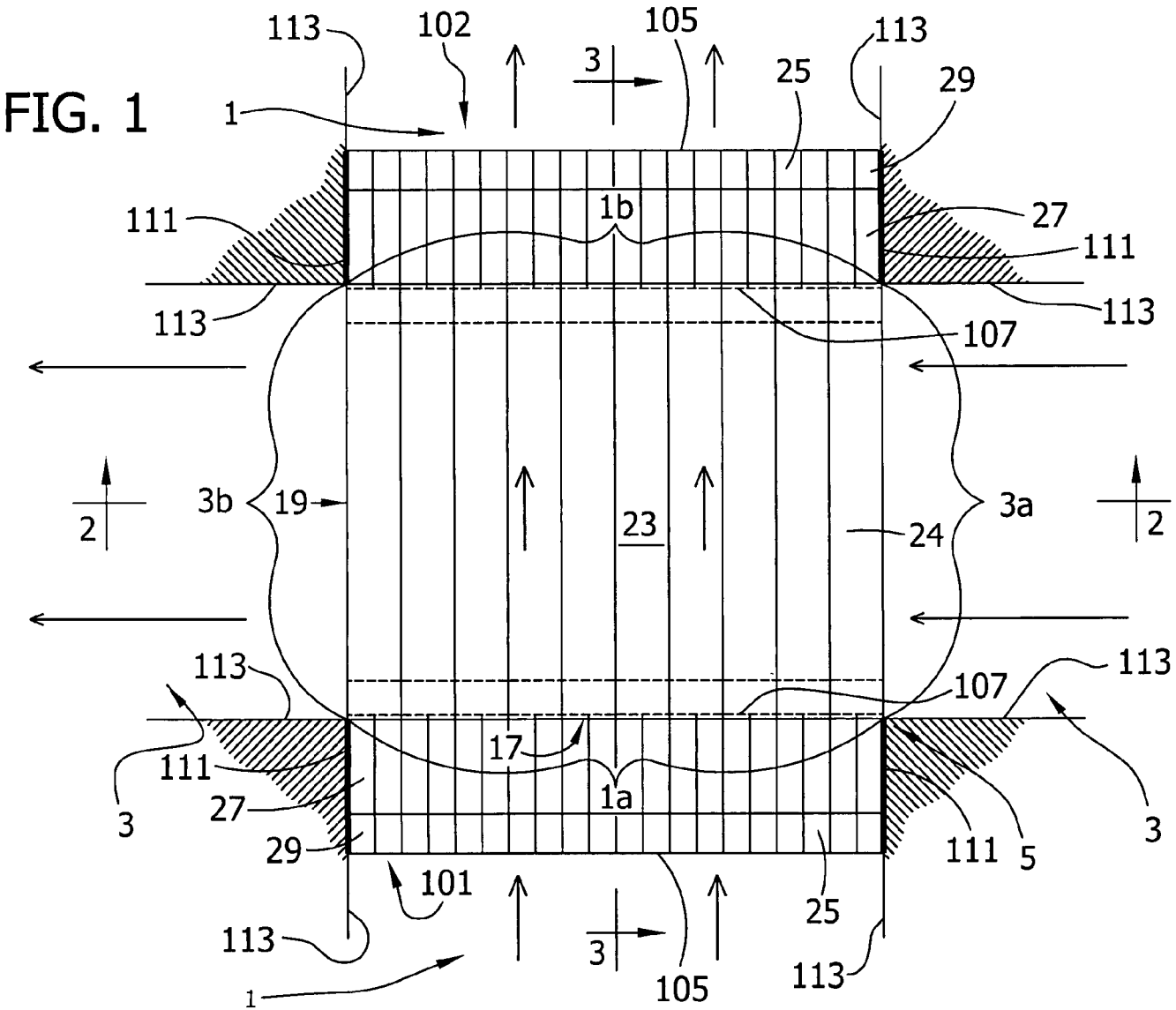
FIG. 1 is a view generally in horizontal section on the plane of the roof of two intersecting passages looking down and on line 1—1 of FIG. 2 showing one embodiment of an overcast construction having upstream and downstream air deflectors.
Figure 2:
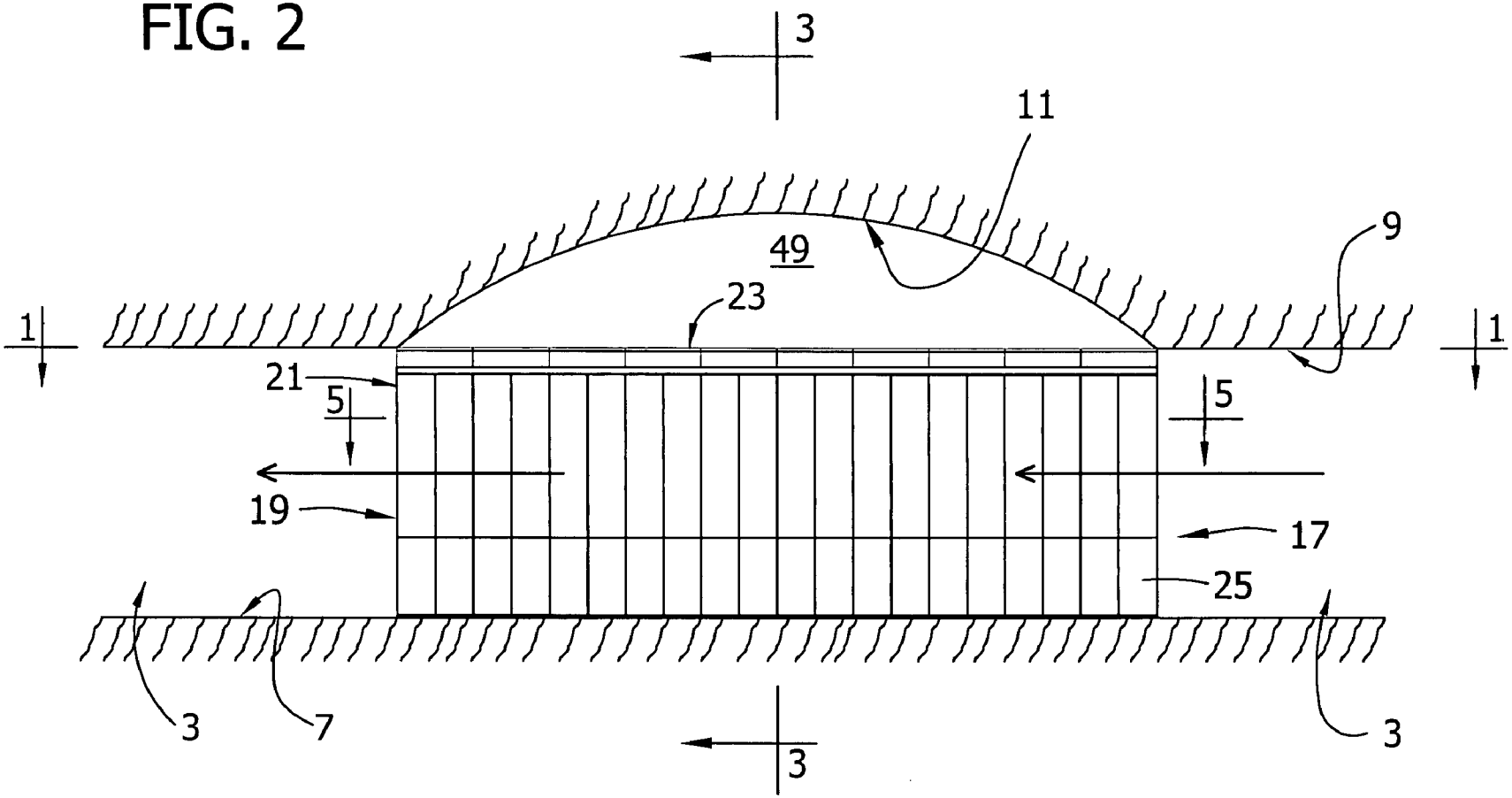
FIG. 2 is a view of the overcast construction shown in FIG. 1 generally in vertical section on the central vertical longitudinal plane of one of the passages and on line 2—2 of FIGS. 1 and 3.
Figure 3:
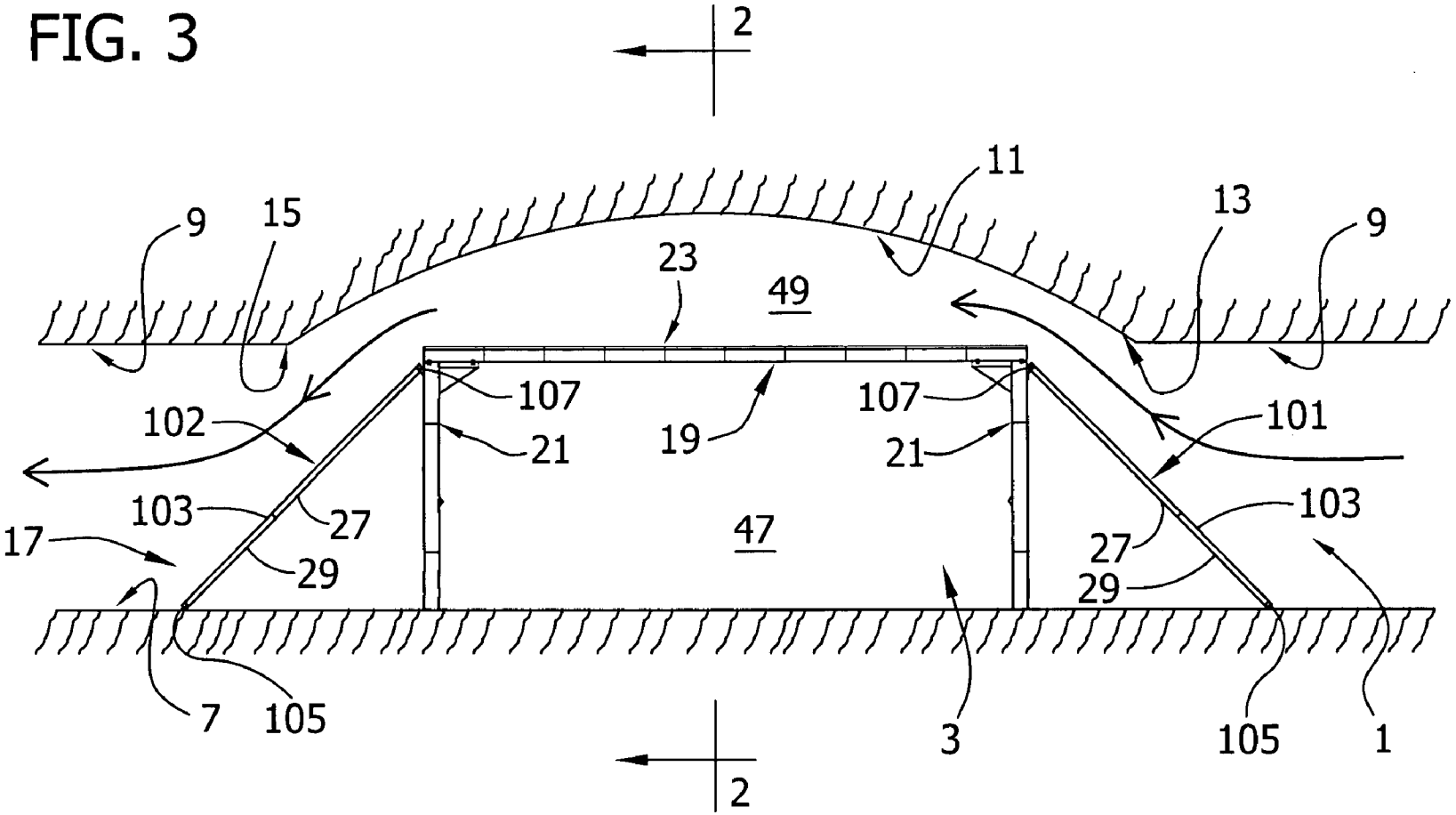
FIG. 3 is a view of the overcast construction shown in FIGS. 1 and 2 generally in vertical section on the central longitudinal plane of the other passage and on line 3—3 of FIGS. 1 and 2.

Referring now to the drawings, first more particularly to FIG. 1, indicated at 1 and 3 are two intersecting passages in a mine (e.g., an underground coal mine). Each passage 1, 3 constitutes an airway for flow of air as indicated by the arrows in FIG. 1 for ventilation of the mine. Airway 1 may be referred to as the first airway and airway 3 may be referred to as the second airway. Each airway 1, 3 has an upstream and a downstream mouth at the intersection 5, the upstream mouths being indicated at 1*a* and 3*a* and the downstream mouths being indicated at 1*b* and 3*b*, respectively. The sides of the airways 1, 3 are defined by ribs 113. Referring to FIGS. 2 & 3, the floor in the passages and intersection is indicated at 7 and the roof in the passages and intersection is indicated generally at 9. The roof 9 has a dome formation 11 extending from a location 13 somewhat upstream of the upstream mouth 1*a* of the first airway 1 to a location 15 somewhat downstream of the downstream mouth 1*b* of the first airway.

A mine ventilation structure, generally designated 17, is installed at the intersection 5. The mine ventilation structure 17 includes a tunnel-forming overcast 19. In the present embodiment, the overcast 19 comprises a pair of generally parallel sidewalls generally designated 21, each of which walls off at least a portion of a respective mouth 1*a*, 1*b* of the first airway 1 (as shown in FIG. 3). The overcast 19 further comprises a deck 23 spanning the sidewalls 21 at the top and connected thereto. The sidewalls 21 and deck 23 suitably comprise a plurality of elongate panels 24, 25, respectively, generally in parallel side-by-side relation, as disclosed in U.S. Pat. No. 6,264,549 (incorporated above) and U.S. Pat. No. 6,669,551, the contents which are hereby incorporated by reference, but many different types of overcasts may be used within the scope of the invention.

The overcast 19 extends across the intersection 5 with the sidewalls 21 thereof substantially walling off the upstream and downstream mouths, 1*a* and 1*b* respectively, of the first airway 1. The space 47 (FIG. 3) between the sidewalls 21 and below the deck 23 constitutes a tunnel for flow of air from the upstream mouth 3*a* to the downstream mouth 3*b* of the second airway 3. The space between the deck 23 and the dome formation 11 constitutes an above-the-deck passage 49 establishing communication for flow of air from upstream of the overcast 19 in the first airway 1 to downstream of the overcast in the first airway. Thus, the overcast 19 bypasses air flowing in the first airway 1 over the air flowing in the second airway 3 and substantially prevents air in the airways 1, 3 from mixing.

Figure 4:
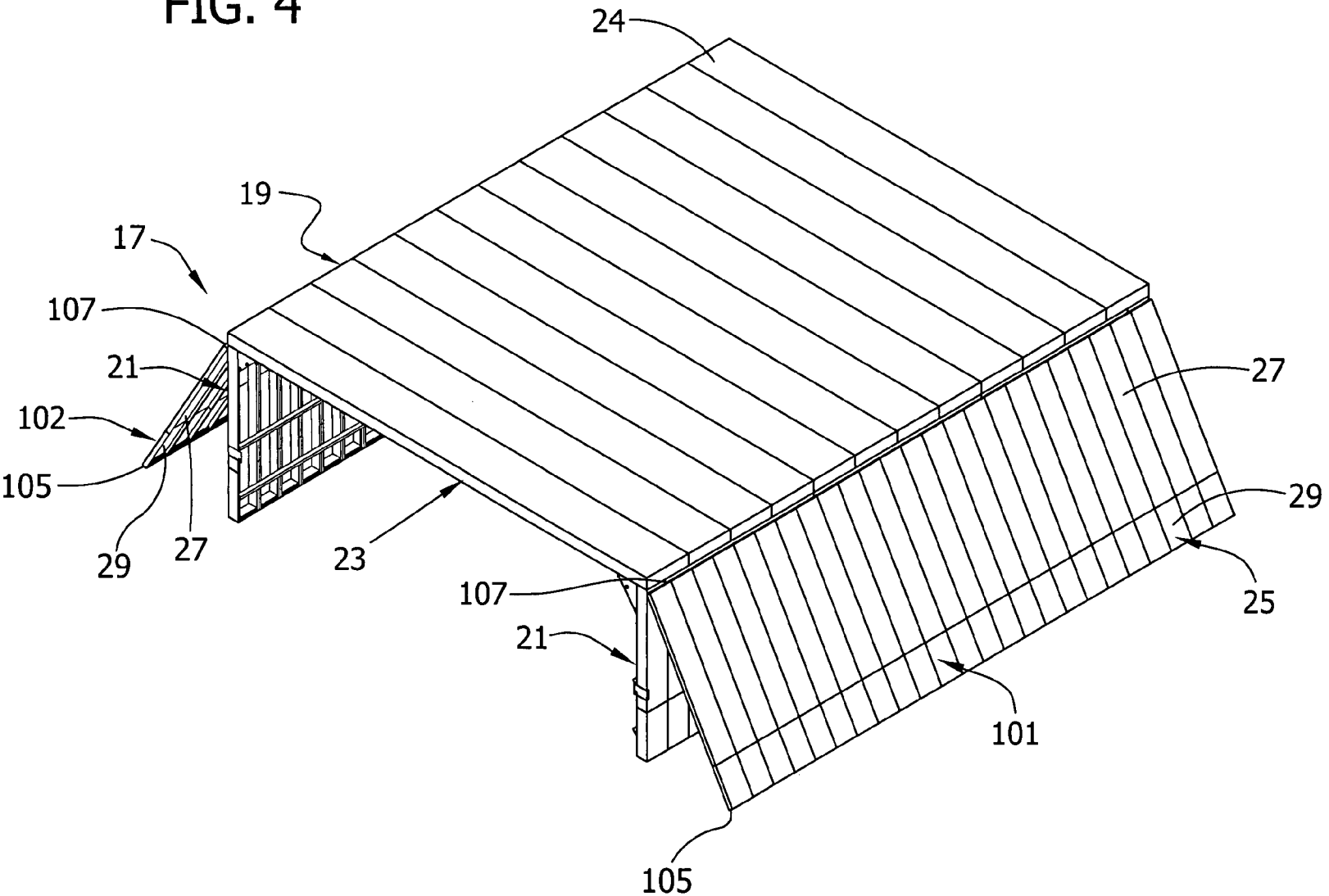
FIG. 4 is a perspective view of the overcast construction shown in FIGS. 1–3.

Air deflectors 101, 102 are located in the first airway 1 upstream and downstream from the overcast 19, respectively. Each of the air deflectors 101, 102, as best illustrated in FIGS. 3–4, comprises an inclined wall 103. Each of the inclined walls 103 has a lower edge 105 spaced from the respective sidewall 21 of the overcast 19 and resting on the floor 7 of the first airway 1. The inclined walls 103 slope up from their lower edges 105 toward the above-the-deck passage 47, the upper edges of the inclined walls 103 being designated 107.

Figure 5:
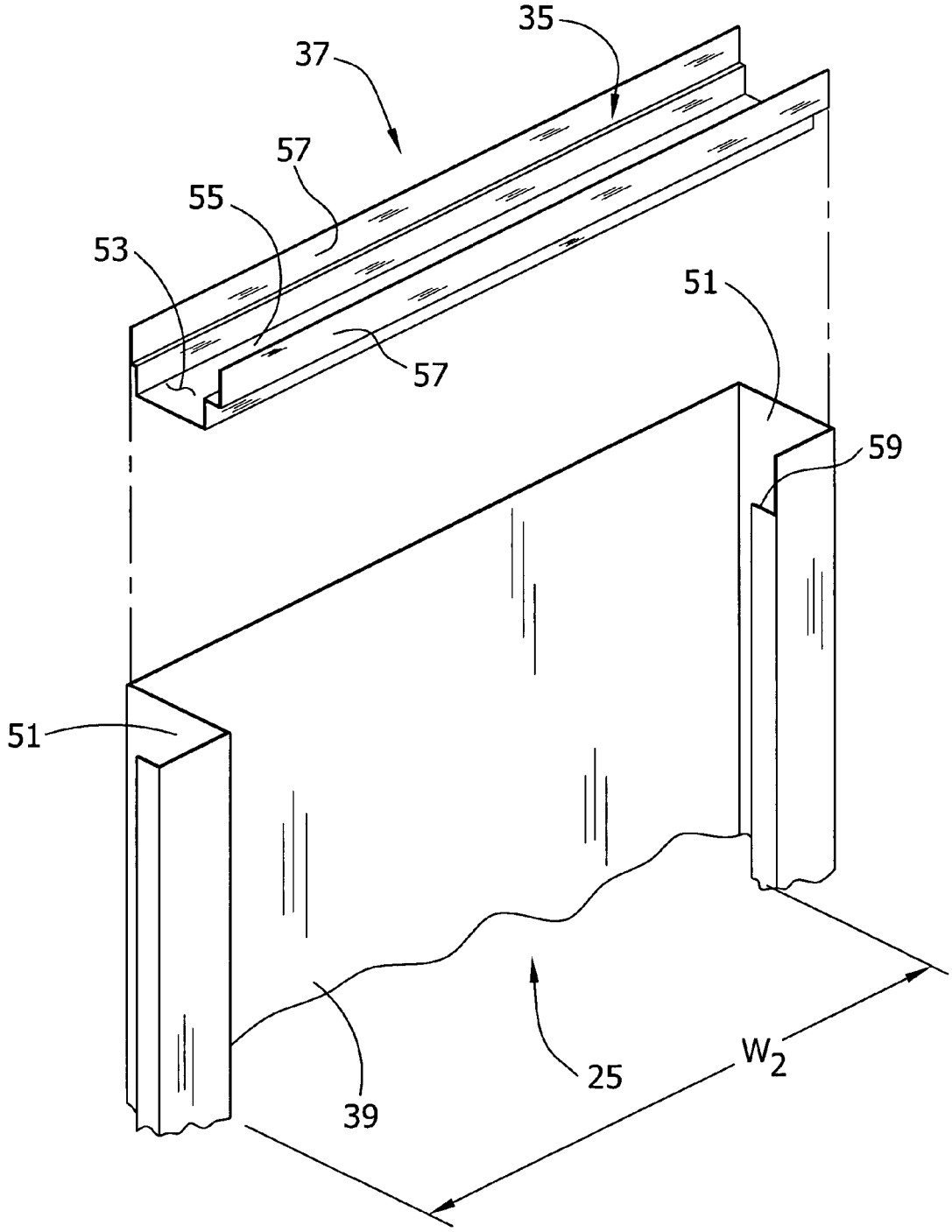
FIG. 5 is an enlarged partial perspective view of an elongate panel member showing a head and interlocking side flanges of the panel.

In this embodiment, each inclined wall 103 comprises a plurality of prefabricated elongate extensible panels, each panel being designated 25 in its entirety, generally in side-by-side relation. The panels 25 of the inclined wall 103 have the same design as the panels 25 of the overcast sidewall 21 in this embodiment, as indicated by their common designation, but they could differ without departing from the scope of the invention. The panels 25 comprise a web 39 and a pair of generally opposing side flanges 51 connected to the sides of the web 39 and defining sides of the panel 25. Each panel 25 comprises an upper member herein numbered 27 and a lower member herein numbered 29, one of the upper 27 and lower 29 members having a telescoping sliding fit in the other. As herein illustrated, the inclined wall 103 of each air deflector 101, 102 is arbitrarily shown as comprising 20 such panels 25. The number of panels 25 needed will vary with the width of the panels and the desired width of the inclined wall 103. The panels 25 can be substantially identical to either the panels shown in U.S. Pat. No. 6,264,549 (incorporated above) or in U.S. patent application Ser. No. 10/951,116 filed Sep. 27, 2004 (hereinafter the '116 application), the contents of which are hereby incorporated by reference. Each panel 25 is suitably fastened to its neighboring panel(s) 25. For example, adjacent panels 25 can be fastened to each other with one or more tie bars or by interlocking side flanges 51 (FIG. 5) as disclosed in the '116 application. Further, the panels 25 can comprise wall sections (i.e., a preassembled set of panels joined together in side-by-side relation) as described in U.S. patent application Ser. No. 10/266,182, the contents of which are hereby incorporated by reference.

The inclined walls 103 of the air deflectors 101, 102 can simply lean against the overcast 19 without being secured thereto, but can also be secured to the overcast 19 if desired. For example, brackets can be fastened to the overcast 19 to hold the inclined walls 103 in position. In one embodiment, a head 37 (shown FIG. 5) is mounted in each panel 25 and releasably secured to the overcast by a bracket. The head 37 of this embodiment comprises a metal body 35 comprising a web 55 and opposing flanges 57 attached to the sides of the web, thereby giving the head 37 a channel-shaped transverse cross section. The head 37 is suitably made by bending sheet metal or another suitable material. The head 37 is secured (e.g., welded) to the web 39 of the panel 25 at the end of the panel member 25 between the flanges 51 so its channel 53 runs parallel to the web 39 and faces the proximate end of the panel. The head 37 contacts the end of a lip 59 of one of the flanges 51. Heads for some types of extensible panels are generally shown in U.S. Pat. Nos. 4,820,081 and 4,483,642, the contents of which are each hereby incorporated by reference, and in the '116 application.

Figure 6:
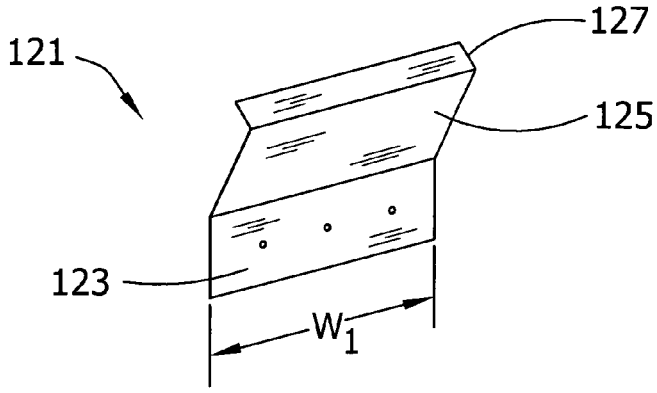
FIG. 6 is a perspective view of a bracket.

FIG. 6 shows one exemplary bracket 121 for securing a panel 25 of an inclined wall 103 to the overcast 19. The bracket 121 comprises a mounting plate 123, a supporting plate 125, and a flange 127. The mounting plate 123 is sized and shaped to mate with the overcast 19 (e.g., sidewall 21) to which it is fastened as described below. The supporting plate 125 extends from one end of the mounting plate 123 and forms an obtuse angle therewith (e.g., between about 35 and about 55 degrees). The flange 127 extends from an end of the supporting plate 125 opposite the mounting plate 123. The flange 127 is approximately perpendicular to the supporting plate 125 in the illustrated embodiment. The bracket 121 can suitably be formed by bending a flat rectangular piece of sheet metal to form the mounting plate 123, supporting plate 125, and flange 127. The width W1 of the bracket 121 is about the same as, but slightly less than, the distance W2 (FIG. 5) between the flanges 51 of an extensible panel 25.

Figure 7:
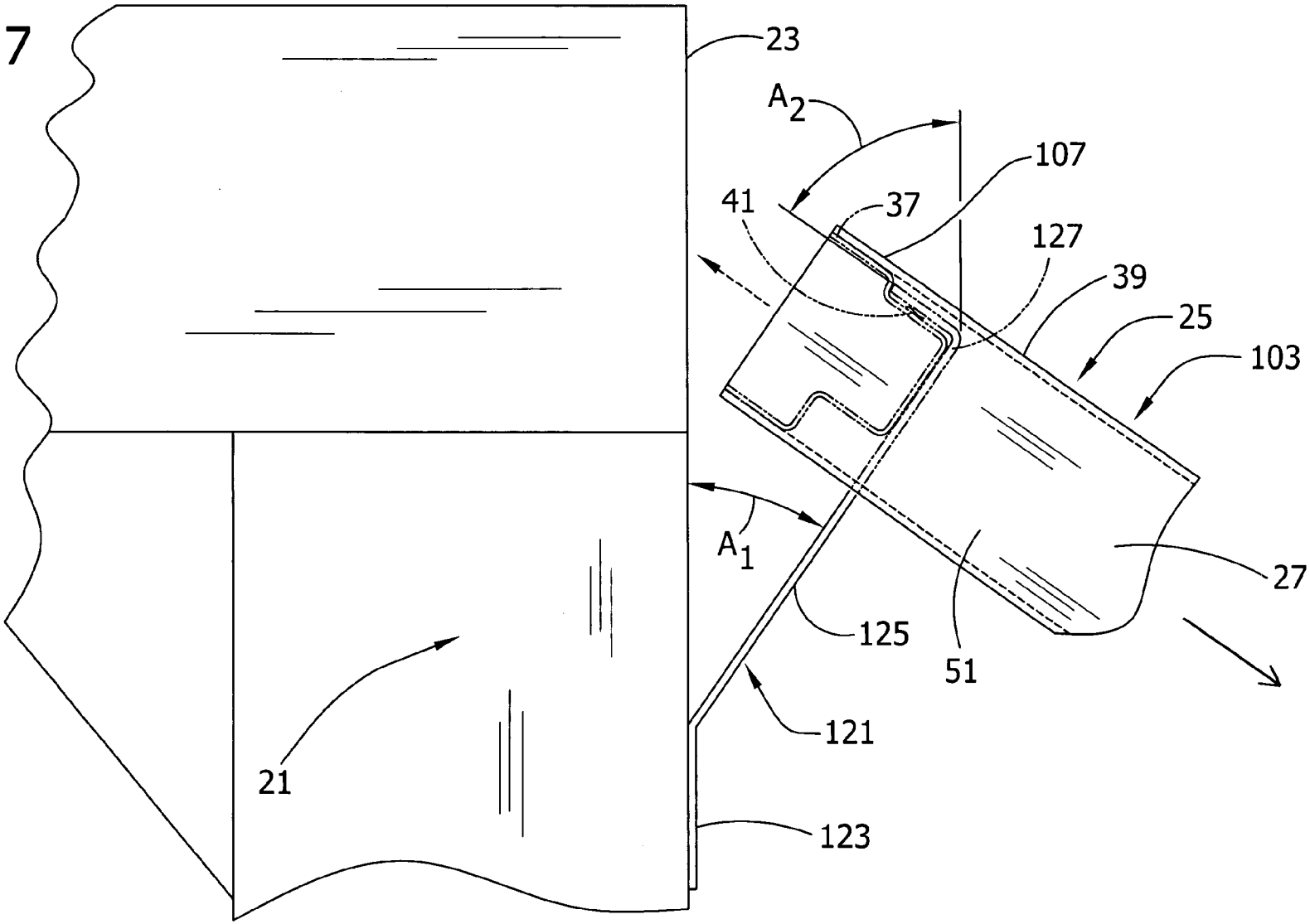
FIG. 7 is an enlarged partial side view of the overcast construction shown in FIGS. 1–4 showing the bracket shown in FIG. 6 and an air deflector secured to the side of the overcast by the bracket.
Figure 8:
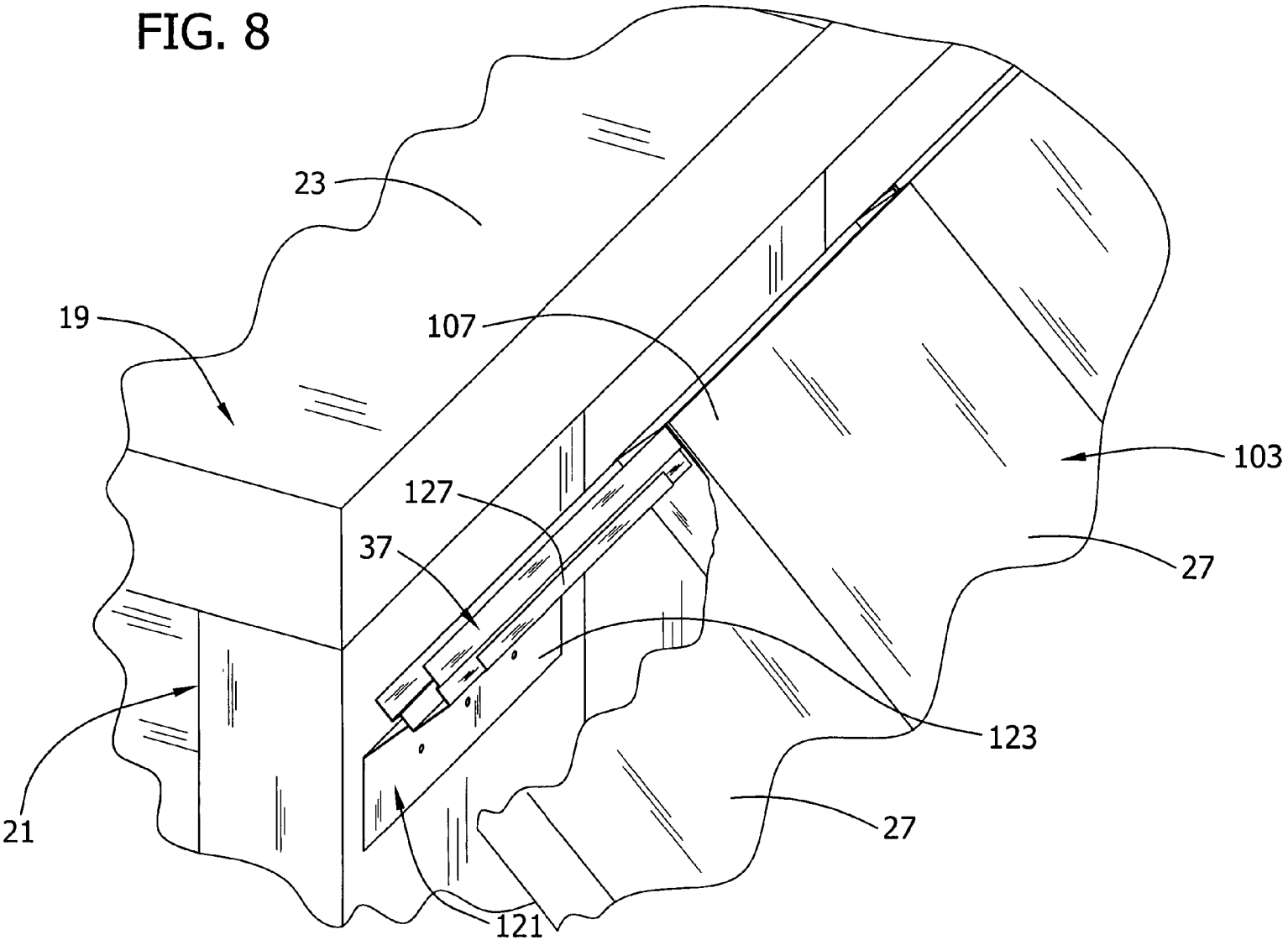
FIG. 8 is an enlarged partial perspective view of the overcast construction shown in FIG. 7 in which parts have been broken away to show the relation of the bracket to the air deflector.

Referring to FIGS. 7 and 8, the mounting plate 123 is fastened to the sidewall 21, as by conventional fasteners (not shown). As mounted on the overcast 19, the mounting plate 123 is parallel to the sidewall 21 (e.g., substantially vertical), the supporting plate 125 extends up and away from the sidewall 21 at an angle A1 (e.g., about 45 degrees from vertical), and the flange 127 extends up and toward the sidewall 21 at an angle A2 (e.g., about 45 degrees from vertical).

To mount a first panel 25 of inclined wall 103, the head 37 of the panel is hung from the bracket 121 by orienting the first panel so the web 39 of the upper extensible panel member 27 is adjacent and substantially parallel to the flange 127. The first panel 25 is then slid down (in the direction of the solid arrow on FIG. 7) until the head 37 rests against the supporting plate 125, the flange 127 being received in a slot 41 between the panel web 39 and the head. In this mounted position, the flange 127 and/or supporting plate 125 support the head 37 and thereby releasably secure the panel 25 to the overcast 19. The bracket 121 can indirectly support a plurality of additional panels 25 secured to the first panel. Additional brackets 121 can be used as needed to directly or indirectly support additional panels 25 of the inclined wall 103. As shown, the upper edge 107 of the inclined wall 103 is generally at the top of the sidewall 21. The panels 25 are extended so that the lower edge 105 of the inclined wall rests on or adjacent the floor 7.

The panel 25 can easily be unhooked from the overcast 19 by sliding the panel 25 up (in the direction of dashed arrow in FIG. 7) until the flange 127 clears the slot 41, thereby releasing the panel from the overcast. Thus, the air deflectors 101, 102 can easily be detached from the overcast 19 if the mine ventilation structure 17 is to be uninstalled or moved to another intersection.

Figure 9:
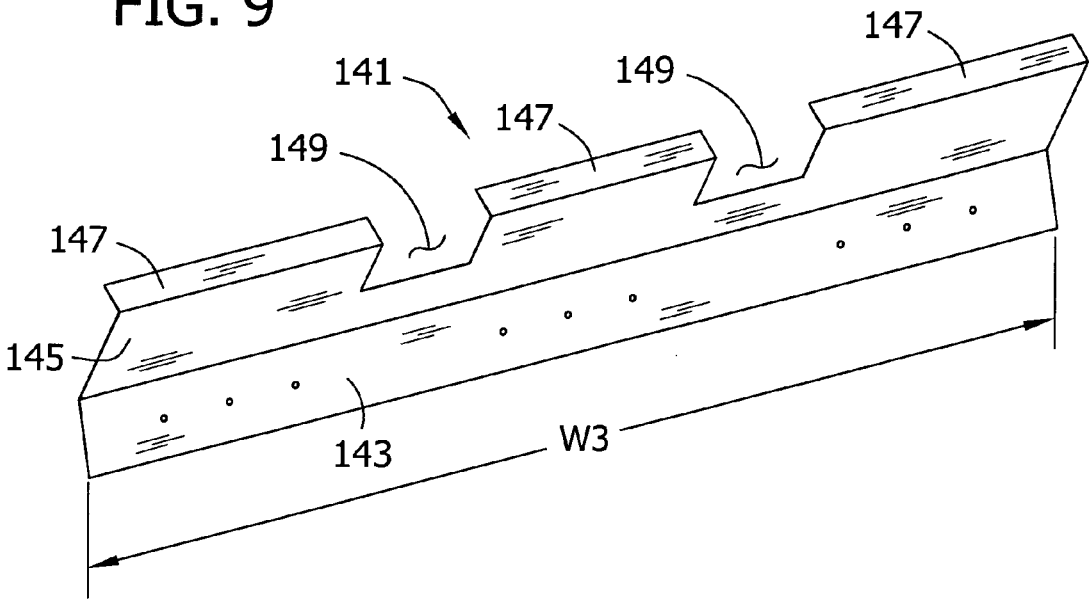
FIG. 9 is a perspective view of a multi-panel bracket.

In another embodiment, a multi-panel bracket 141 (FIG. 9) directly supports multiple extensible panels 25 of an inclined wall 103. The multi-panel bracket 141 is similar to the bracket shown in FIG. 6 in that it comprises a mounting plate 143 and a supporting plate 145 extending from the mounting plate and forming an obtuse angle therewith. In this embodiment, three flanges 147 extend from the supporting plate 145 and are angularly disposed thereto. In contrast to the bracket 121 shown in FIG. 6, the width W3 of the multi-panel bracket 141 is about equal to the width of multiple (e.g., three) extensible panels 25. Further, a series of notches 149 (e.g., two) has been formed in the bracket 141 between the flanges 147 and extending partially into the supporting plate 145. The bracket 141 can be formed by bending a single rectangular piece of sheet metal having notches corresponding to the notches 149 between the flanges 147.

Figure 10:
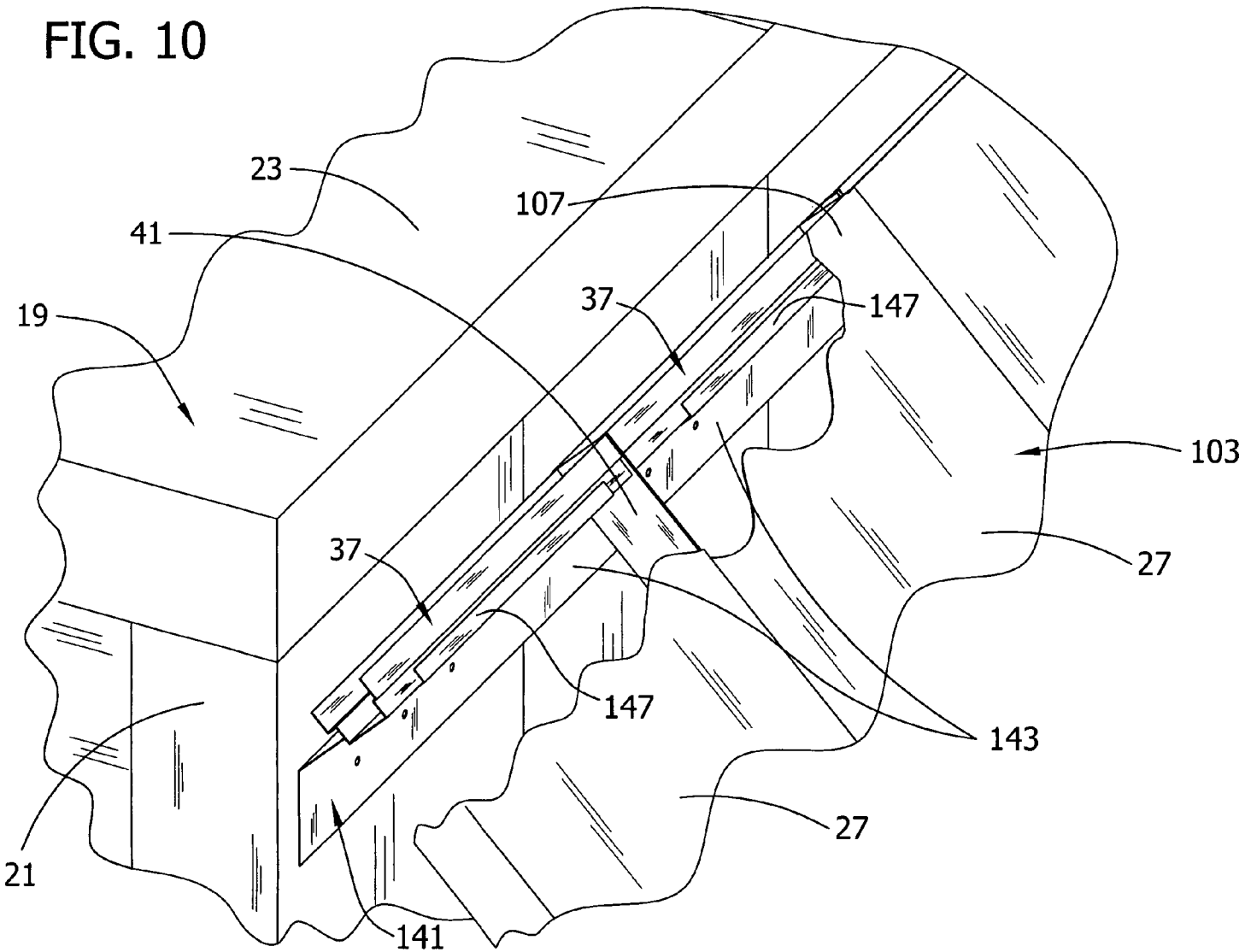
FIG. 10 is an enlarged partial perspective view of another embodiment of an overcast construction in which parts have been broken away to show the multi-panel bracket shown in FIG. 9 and an air deflector secured to the side of an overcast by the multi-panel bracket.

Referring to FIG. 10, the multi-panel bracket 141 is fastened to the sidewall 21 of the overcast 19 and panels 25 are hung on each of the flanges 147 in generally the same manner as described above for the single-panel bracket 121. The side flanges 51 of the panels 25 are received in the notches 149, thereby allowing the bracket 141 to span the width of multiple panels 25 without interfering with the flanges of the panels. In other embodiments, any number of panels 25 can be hung on a single multi-panel bracket 141 by adjusting the width W3 of the bracket 141 and providing a sufficient number of notches 149 to receive the side flanges 51 of the panels 25. Other panels 25 can be indirectly supported by the bracket 141 by being secured to the panels that are directly supported by the bracket. Further, one or more multi-panel brackets 141 could be used in combination with one or more single-panel brackets 121 to secure an inclined wall 103 to the overcast 19.

It will be understood that brackets 121, 141 are merely exemplary means for securing the inclined wall 103 to the overcast 19. Other means of securing the inclined wall to the overcast are contemplated as being within the scope of the invention.

The upstream air deflector 101 begins channeling air flowing in the first passage 1 into the above-the-deck passage 49 before the air reaches the overcast 19, resulting in less abrupt transition of airflow from the airway 1 upstream of the overcast 19 to the above-the-deck passage 49. This reduces the shock loss associated with the overcast 19 and reduces the energy demands on the mine's ventilation system. Likewise, the downstream air deflector 102 facilitates transition of airflow from the above-the-deck passage 49 into the first airway 1 downstream of the overcast 19. This transition is facilitated because the air tends to follow the surface of the downstream air deflector 102. (The Coanda effect describes the tendency of a flowing fluid (such as air) to follow a solid surface.) This further reduces shock loss in the first airway 1 associated with the overcast 19 and reduces demands on the ventilation system. By reducing the shock loss associated with the overcast 19, the air deflectors 101, 102 can be used to increase the amount of air flowing through the mine without increasing the energy used by the mine's ventilation system.

Gaps are provided between the inclined walls 103 and the ribs 113 at locations designated 111 in FIG. 1. The gaps do not need to be very wide. Any size opening sufficient to equalize static pressure differentials on the inclined wall 103 will suffice. For example, the inclined walls 103 of the air deflectors 101, 102 can extend virtually all the way across the airway 1 as shown in FIG. 1. The gaps can suitably be provided at locations 111 between the inclined walls 103 and the ribs 113 of the mine by simply not sealing the inclined walls to the ribs, resulting in a small gap (e.g., only a few inches). The gaps may be wider (e.g., greater than one foot) without departing from the scope of the invention. For example, the gaps may be greater than one foot if the inclined wall 103 is not designed to extend all the way across the airway 1 or due to corner pillar rash, which can also result in a significant space between the inclined wall and the rib 113.

The gaps 111 equalize static pressure on the inclined walls 103 of the deflectors 101, 102. Any static pressure differential is eliminated because air flows through the gaps 111 to equalize the pressure. Accordingly, the inclined walls 103 are subjected only to velocity-based pressure differentials. This prevents the inclined walls 103 from being subjected to any substantial air loading, allowing them to be constructed of lighter weight materials, thereby reducing the cost.

Figure 11:
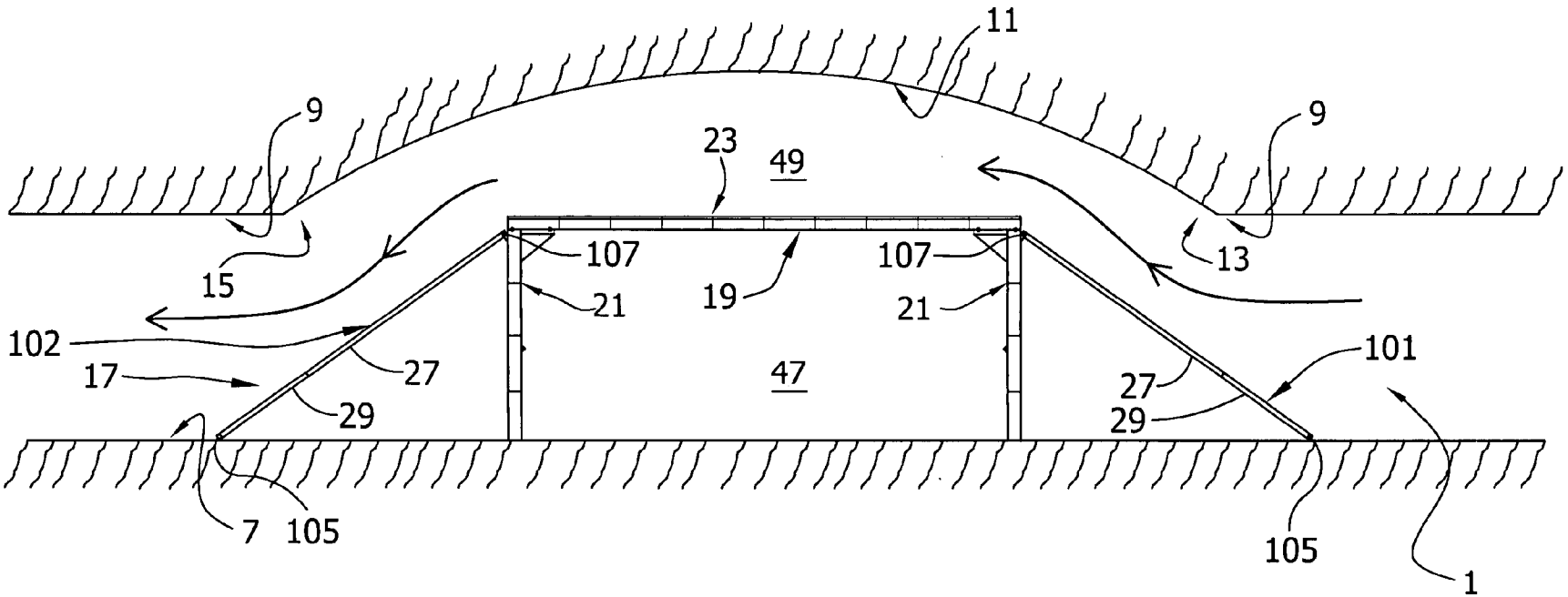
FIG. 11 is a view of the overcast construction shown in FIGS. 1–4 similar to FIG. 3 in which the air deflectors have been adjusted to better suit a larger dome formation in the roof of the intersection.

Further, the air deflectors 101, 102 can be adjusted to suit the characteristics of the intersection. The size and shape of the dome formation 11 may vary from one intersection to another. Likewise, the dome formation 11 of an intersection can be deformed over time by the overburden. Referring to FIG. 11, for example, if the dome formation 11 extends relatively farther into the passage 1, the lower edge 105 of one or both of the inclined walls 103 can be lifted off the floor 7 and the panels 25 can be extended until the lower edge rests on the floor again. This will make the inclined wall 103 less steep and result in less abrupt transitions between the passage 1 and the above-the-deck passage 49. On the other hand, if the dome formation 11 extends a relatively shorter distance into the passage 1, as shown in FIG. 3, the deflectors 101, 102 might choke the airway 1 and become counterproductive if they extend too far into the passage 1. To prevent such choking, the extensible panels 25 can be retracted and the angle of the inclined wall steepened until the lower edge 105 of the inclined wall 103 rests on the floor again 7. The brackets 121, 141 described above generally include enough play to allow minor adjustments to the angle of incline of the air deflectors 101, 102. More extensive adjustments can be made simply by using the inclined wall 103 as a lever to bend brackets 121 and/or 141 as required to make the desired adjustment.

If for any reason it is desired to uninstall the mine ventilation structure 17 from the intersection, the air deflectors 101, 102 can be detached from the overcast 19 and removed with minimal labor. The deflectors 101, 102 can be transported to a different intersection (in the same mine or a different mine) for use with a different overcast. Likewise, the entire mine ventilation structure 17 can be uninstalled from the intersection and then installed in another intersection with little more effort than would be required to do the same with just the overcast 19.

In some cases, either of the upstream 101 or downstream 102 air deflectors, by itself, may be sufficient to achieve the desired or needed shock loss reduction, in which case the other deflector may be omitted from the overcast construction. Similarly, if a limited number of air deflectors are available at a particular mine, it may be more advantageous to use one of the air deflectors with a first overcast and another of the air deflectors with a second overcast.

Many variations can be made to the exemplary embodiments shown in the drawings and described. To provide just a few examples, the air deflector could comprise a non-planar wall or a wall that does not comprise a plurality of extensible panels without departing from the scope of the invention. The air deflectors 101, 102 could also be modified to include steps for people to walk across the overcast construction. If the deflector is sealed to the ribs 113 thereby eliminating the gaps 111, equivalent openings could be provided elsewhere (e.g., by drilling one or more holes through the deflector) to equalize static pressure differentials acting on the deflector. A similar gap could also be provided between the lower edge of the deflector and the floor, although this might introduce additional turbulence to flow of air through the airway and offset some of the energy savings for the ventilation system.

Those skilled in the art will also recognize that the benefits of the invention with respect to airflow through the above-the-deck passage do not depend on the connection of the deflector to the overcast. Thus, the air deflectors can be secured to the overcast at a different location or in a different manner. The inclined wall can also simply rest against the overcast without departing from the scope of the invention. Alternatively, a separate support can be provided for the deflector to eliminate the need for the overcast to support the deflector.

Figure 12:
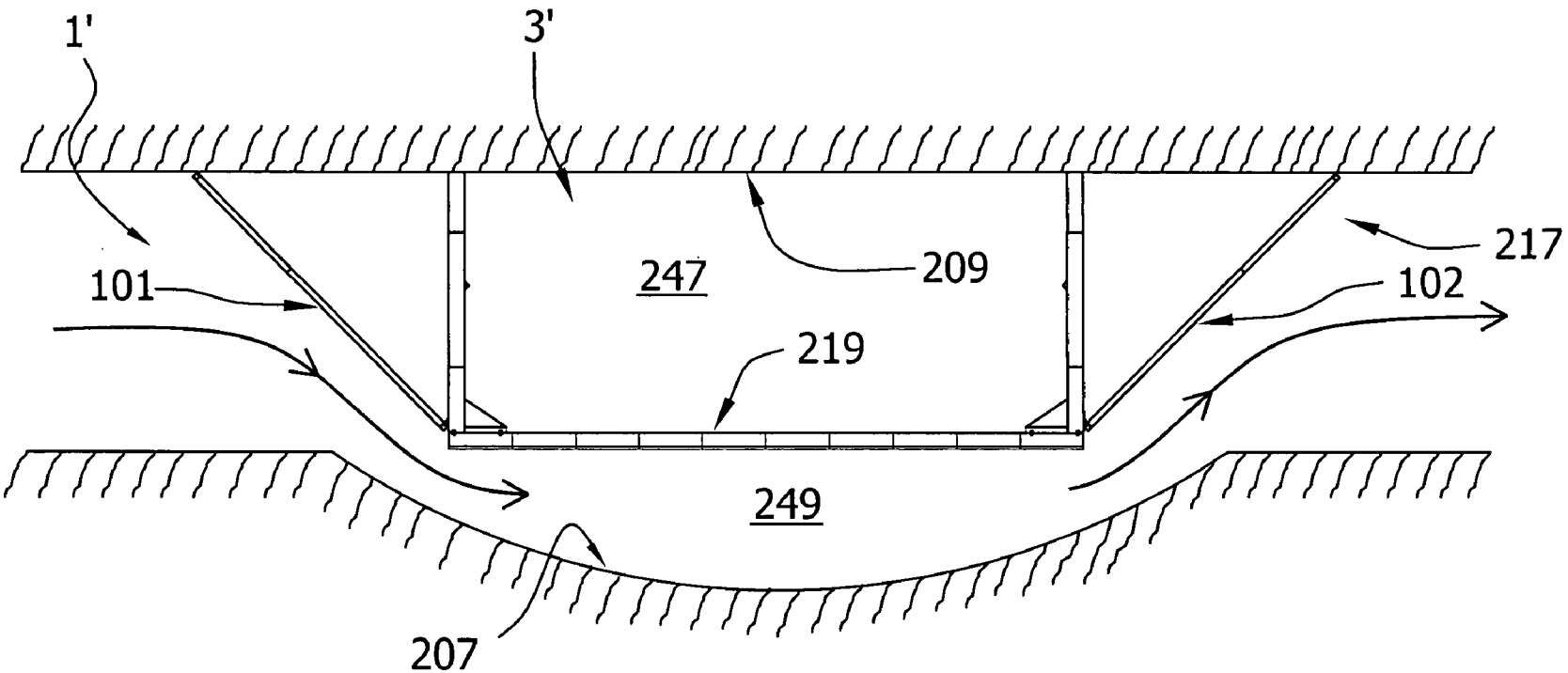
FIG. 12 is a side view (similar to FIG. 3) of one embodiment of an undercast construction of the present invention.

Further, those skilled in the art will recognize that the air deflectors could be used in connection with a tunnel-forming undercast without departing from the scope of this invention. As shown in FIG. 12, for example, an undercast construction 217 comprises a tunnel forming undercast 219 forming a tunnel 247 for flow of air in the second airway 3' through the intersection. The floor 207 of the intersection and the floor of the first airway 1' adjacent the undercast 219 is formed to provide an under-the deck passage 249 establishing fluid communication for flow of air through the first airway 1' from one side of the undercast 219 to the other. Air deflectors 201, 202 (e.g., inclined walls) are hung using any suitable fasteners (not shown) from the roof 209 adjacent the upstream and/or downstream sides of an undercast 219 to reduce shock loss associated with flow of air under the tunnel of the undercast.

When introducing elements of the present invention or the preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above compositions, products, and methods without departing from the scope of the invention, it is intended that all matter contained in the above description and shown in the accompanying drawings shall be interpreted as illustrative and not in a limiting sense.

What is claimed is:

1. A mine ventilation structure incorporated at the intersection of first and second intersecting passages in a mine, the passages constituting first and second airways for flow of air for mine ventilation, the intersection having a floor and a roof and the airways each having a floor, ribs at the sides and a roof with an upstream and a downstream mouth at the intersection, said structure comprising a tunnel-forming overcast at the intersection comprising a pair of side walls each walling off at least a portion of a respective mouth of the first airway and a deck spanning the side walls and connected thereto, the space between the side walls and below the deck constituting a tunnel for flow of air from the upstream to the downstream mouth of the second airway, the roof above the deck and the roof of the first airway adjacent the ends of the deck being formed to provide an above-the-deck passage establishing communication for flow of air through the first airway over the deck from one side of the overcast to the other, and an air deflector in the first airway adjacent the overcast, the air deflector comprising an inclined wall, a lower edge of the inclined wall being spaced from the overcast in the first airway, the inclined wall sloping up from its lower edge toward the above-the-deck passage.

2. A mine ventilation structure as set forth in claim 1 wherein the lower edge of the inclined wall is upstream of the overcast in the first airway.

3. A mine ventilation structure as set forth in claim 1 wherein the lower edge of the inclined wall is downstream of the overcast in the first airway.

4. A mine ventilation structure as set forth in claim 1 wherein the ribs, inclined wall, and overcast partially enclose a space between the inclined wall and the overcast, the space being in fluid communication with the first airway.

5. A mine ventilation structure as set forth in claim 1 wherein the inclined wall is secured to the overcast.

6. A mine ventilation structure as set forth in claim 5 wherein the inclined wall comprises at least one panel, the at least one panel comprising a head at an upper edge of the inclined wall, the head being releasably secured to the overcast by a bracket fastened to the overcast.

7. A mine ventilation structure as set forth in claim 6 wherein the at least one panel is an extensible panel comprising an upper panel member defining at least a portion of the upper edge of the inclined wall and a lower panel member defining at least a portion of the lower edge the inclined wall, the lower edge being adjacent the floor in the first airway, and wherein the bracket allows for pivotal movement of the inclined wall.

8. A mine ventilation structure as set forth in claim 1 wherein the inclined wall comprises a plurality of extensible panels extending in side-by-side generally parallel relation.

9. A mine ventilation structure as set forth in claim 8 wherein the panels are extensible between the lower and an upper edge of the respective inclined wall.

10. A mine ventilation structure as set forth in claim 1 wherein the air deflector constitutes a first air deflector, the structure further comprising a second air deflector comprising an inclined wall, a lower edge of the inclined wall of the second deflector being spaced from the overcast and adjacent the floor in the first airway, the inclined wall of the second air deflector sloping up from its lower edge toward the above-the-deck passage, the lower edge of the inclined wall of one of the first and second air deflectors being upstream of the overcast and the lower edge of the inclined wall of the other of the first and second deflectors being downstream of the overcast.

11. A mine ventilation structure as specified in claim 10 wherein each of the inclined walls of the first and second deflectors comprises a plurality of extensible panels in side-by-side relation, said panels being extensible between the lower and an upper edge of the respective inclined wall.

12. A mine ventilation structure incorporated at the intersection of first and second intersecting passages in a mine, the passages constituting first and second airways for flow of air for mine ventilation, the intersection having a floor and a roof and the airways each having a floor, ribs at the sides and a roof with an upstream and a downstream mouth at the intersection, said structure comprising a tunnel-forming overcast at the intersection comprising a pair of side walls each walling off at least a portion of a respective mouth of the first airway and a deck spanning the side walls and connected thereto, the space between the side walls and below the deck constituting a tunnel for flow of air from the upstream to the downstream mouth of the second airway, the roof above the deck and the roof of the first airway adjacent the ends of the deck being formed to provide an above-the-deck passage establishing communication for flow of air through the first airway over the deck from one side of the overcast to the other, and an air deflector in the first airway adjacent a side of the overcast for deflecting the flow of air in the first airway, the air deflector comprising at least one prefabricated panel having a lower edge spaced apart from the overcast in the first airway and extending up from its lower edge toward the above-the-deck passage.

13. A mine ventilation structure as set forth in claim 12 wherein the air deflector comprises a plurality of prefabricated panels fastened together in generally side-by-side relation to form an inclined wall.

14. A mine ventilation structure as set forth in claim 12 wherein the lower edge of the prefabricated panel is upstream of the overcast in the first airway.

15. A mine ventilation structure as set forth in claim 12 wherein the lower edge of the prefabricated panel is downstream of the overcast in the first airway.

16. A mine ventilation structure as set forth in claim 12 wherein the prefabricated panel is secured to the overcast.

17. A mine ventilation structure as set forth in claim 16 wherein the prefabricated panel comprises a head at an upper edge of the panel, the head being releasably secured to the overcast by a bracket fastened to the overcast.

18. A mine ventilation structure as set forth in claim 17 wherein the prefabricated panel is an extensible panel comprising an upper panel member defining the upper edge of the panel and a lower panel member defining the lower edge the panel, the lower edge being adjacent the floor in the first airway, and wherein the bracket allows for pivotal movement of the prefabricated panel.

19. A mine ventilation structure as set forth in claim 12 wherein the air deflector constitutes a first air deflector and the prefabricated panel constitutes a first panel, the structure further comprising a second air deflector comprising a second prefabricated panel having a lower edge spaced apart from the overcast in the first airway and extending up from its lower edge toward the above-the-deck passage, the lower edge of one of the first and second prefabricated panels being upstream of the overcast and the lower edge of the other of the first and second prefabricated panels being downstream of the overcast.

20. A mine ventilation structure as specified in claim 19 wherein each of the first and second air deflectors comprises a plurality of prefabricated panels fastened together in generally side-by-side relation to form a respective inclined wall.

21. A mine ventilation structure incorporated at the intersection of first and second intersecting passages in a mine, the passages constituting first and second airways for flow of air for mine ventilation, the intersection having a floor and a roof and the airways each having a floor, ribs at the sides and a roof with an upstream and a downstream mouth at the intersection, the ventilation structure comprising a tunnel-forming construction, said construction comprising a pair of side walls each walling off at least a portion of a respective mouth of the first airway and a deck spanning the side walls and connected thereto, the side walls and deck in combination with one of the floor and roof of the intersection defining a tunnel establishing communication of air from the upstream to the downstream mouth of the second airway, at least one of: (a) the roof of the intersection and the roof of the first airway adjacent the ends of the tunnel-forming construction; and (b) the floor of the intersection and the floor of the first airway adjacent the ends of the tunnel-forming construction being formed to provide a passage establishing communication for flow of air through the first airway from one side of the tunnel-forming construction to the other, the side walls and deck substantially maintaining separation of the flow of air from the upstream to the downstream mouth of the second airway from the flow of air from the upstream to the downstream mouth of the first airway, and an air deflector in the first airway adjacent the tunnel-forming construction, the air deflector comprising an inclined wall having a first edge in the first airway spaced from the tunnel-forming construction, the inclined wall sloping from the first edge toward said passage for flow of air through the first airway.

* * * * *